US009180731B2

(12) United States Patent
Duffy

(10) Patent No.: US 9,180,731 B2
(45) Date of Patent: Nov. 10, 2015

(54) PAINTING SUPPORT BOARD

(71) Applicant: William P. Duffy, Tannerville, NY (US)

(72) Inventor: William P. Duffy, Tannerville, NY (US)

( * ) Notice: Subject to any disclaimer, the term of this patent is extended or adjusted under 35 U.S.C. 154(b) by 152 days.

(21) Appl. No.: 13/956,682

(22) Filed: Aug. 1, 2013

(65) Prior Publication Data

US 2015/0034792 A1 Feb. 5, 2015

(51) Int. Cl.
*A47B 97/04* (2006.01)
*B44D 3/00* (2006.01)

(52) U.S. Cl.
CPC ..... *B44D 3/00* (2013.01)

(58) Field of Classification Search
CPC ..... B43L 15/00; B43L 5/02; B43L 5/00; B43L 7/002; B43L 7/007; B43L 13/005; B43L 13/149
USPC ..... 248/448, 451
See application file for complete search history.

(56) References Cited

U.S. PATENT DOCUMENTS

| | | | | | |
|---|---|---|---|---|---|
| 864,254 | A | * | 8/1907 | Perkins | 40/1 |
| 997,418 | A | * | 7/1911 | Sayles | 33/1 AA |
| 1,285,279 | A | * | 11/1918 | McCabe | 33/1 AA |
| 1,506,368 | A | * | 8/1924 | Fancher | 269/54 |
| 2,203,474 | A | * | 6/1940 | Stenquist | 269/254 R |
| 2,503,807 | A | * | 4/1950 | Dolas | 312/231 |
| 2,978,813 | A | * | 4/1961 | Gill | 33/446 |
| 3,738,606 | A | | 6/1973 | Millen | |
| 3,785,299 | A | | 1/1974 | Caperton, Jr. | |
| 3,797,135 | A | * | 3/1974 | Linker et al. | 434/428 |
| 3,926,398 | A | * | 12/1975 | Vincent | 248/448 |
| 3,972,133 | A | * | 8/1976 | Parshall | 434/85 |
| 4,082,452 | A | * | 4/1978 | Becker | 355/74 |
| 4,088,290 | A | * | 5/1978 | Novello | 248/118 |
| 4,148,506 | A | * | 4/1979 | Lamb | 281/45 |
| 4,188,006 | A | * | 2/1980 | Karlin | 248/118.3 |
| 4,318,471 | A | * | 3/1982 | Hutton | 206/214 |
| 4,537,380 | A | * | 8/1985 | Erickson | 248/460 |
| 4,605,246 | A | * | 8/1986 | Haas et al. | 462/78 |
| 4,683,836 | A | * | 8/1987 | West | 118/305 |
| 4,685,644 | A | * | 8/1987 | Yates | 248/118.3 |
| 4,717,109 | A | | 1/1988 | Johnston | |
| 5,141,198 | A | * | 8/1992 | Hoyt | 248/441.1 |

(Continued)

OTHER PUBLICATIONS

Craftech International Inc, "All in One Pochade Box" Sienna Plein Air, Huntington Beach, CA 92648 Found Originally Aug. 28, 2012 at: www.siennapleinair.com/all-in-one.html.

(Continued)

*Primary Examiner* — Bradley Duckworth
(74) *Attorney, Agent, or Firm* — BK Patents, Inc.; Billy J. Knowles

(57) ABSTRACT

A painting support system has a painting support board for holding smaller artist's panels or canvases that is colored so the area surrounding the panel or canvas mimics the frame for the finished painting. A reference line grid are scribed on the painting support board more accurately draw and observe straight lines. A continuous loop strip of a hook and loop system placed on all four sides of the support board. A mahl stick with a hook patch of the hook and loop system placed on a tip of the mahl stick allows the artist to attach the mahl stick anywhere on the support board to the loop strip to steady and support the hand while painting. Panel securing clips are placed in receiving fasteners inserted in fastener holes at fixed locations on the painting support board to allow attaching several different sizes of the paint canvases and panels.

26 Claims, 7 Drawing Sheets

(56) References Cited

U.S. PATENT DOCUMENTS

| | | | | |
|---|---|---|---|---|
| 5,154,391 | A * | 10/1992 | Hegarty | 248/454 |
| 5,172,883 | A * | 12/1992 | Amirian | 248/441.1 |
| 5,193,772 | A * | 3/1993 | Johnston | 248/118.5 |
| 5,494,251 | A * | 2/1996 | Katz | 248/449 |
| 5,882,070 | A * | 3/1999 | Genn | 297/174 R |
| 6,213,439 | B1 * | 4/2001 | Giulie et al. | 248/459 |
| 6,565,059 | B1 * | 5/2003 | Falconer | 248/441.1 |
| 6,568,938 | B1 * | 5/2003 | Prince et al. | 434/90 |
| 6,579,099 | B1 * | 6/2003 | Pipes, Jr. | 434/85 |
| 6,772,987 | B2 * | 8/2004 | Jones, II | 248/464 |
| 7,377,476 | B2 | 5/2008 | Almond et al. | |
| 7,401,410 | B1 | 7/2008 | Jewell | |
| 7,513,773 | B1 * | 4/2009 | Oakes et al. | 434/91 |
| 7,694,806 | B2 | 4/2010 | Huggins | |
| 7,694,931 | B2 * | 4/2010 | Mantelli | 248/441.1 |
| 7,717,393 | B2 * | 5/2010 | Edgmon et al. | 248/460 |
| 7,926,188 | B2 | 4/2011 | Thorkelson | |
| 2004/0007651 | A1 * | 1/2004 | Williams et al. | 248/346.06 |
| 2012/0080580 | A1 * | 4/2012 | Densberger | 248/448 |
| 2013/0065201 | A1 * | 3/2013 | Pool et al. | 434/98 |

OTHER PUBLICATIONS

Thor International PTE LTD, Singapore 408564, Fastener Product Website, Found Jun. 5, 2015 at www.thorintl.com/Contact-Thor-International-Singapore.shtml.

Specialty Fasteners & Components LTD, Devon, TQ9 5AL, England, Product Website, Found Jun. 5, 2015 at www.specialty-fasteners.co.uk.

* cited by examiner 17
42
44b 17
42
44a 15
17
40
42
43
44
41a
41b
45
35

PAINTING SUPPORT BOARD

TECHNICAL FIELD

This disclosure relates generally to a device for retaining a painting or drawing canvas or panel used by an artist. More particularly, the disclosure relates to a device for securing a painting or drawing canvas or panel to an easel and temporarily securing a mahl stick to the device while allowing unlimited adjustment of the mahl stick.

BACKGROUND

As is known in the art, "En plein air" is a French expression that means "in the open air," and is particularly used to describe the act of painting outdoors. The "pochade box" or sketch box was developed for use by artist to carry their supplies for painting and sketching in the "open air" using the natural light. The "All In One Pochade Box" from Sienna Plein Air, Craftech International Inc. Huntington Beach, Calif. 92648, provides a pochade box designed to carry all the essentials for a day of plein air painting. The pochade box has three large storage compartments as well as a wet panel storage compartment that allows you to carry two 9×12 or two 8×10 painting panels.

U.S. Pat. No. 7,694,806 (Huggins) describes an artist's paint box. The paint box has a combination hinged easel and cover and storage compartment having a hinged cover. A removable palette mates within the box and has opposing cutouts substantially parallel to each other and another cutout transverse to the opposing cutouts. The opposing cutouts and the transverse cutout form a substantially U shape. A recessed paint color mixing area is formed between and adjacent the opposing cutouts and adjacent the transverse cutout. A recessed paintbrush and tool holding area is adjacent the transverse cutout and opposing the recessed paint color mixing area. Paint wells are placed within the opposing cutouts and the transverse cutout. Each of the paint wells has opposing side ridges resting on opposing edges adjacent each of the opposing cutouts and other opposing edges adjacent the transverse cutout.

Further, as is known in the art, a mahl stick is a stick or thin pole about a meter in length (three feet) with a ball-shape pad at one end, used as an aid in painting, particularly in oil painting. A mahl stick is useful when painting detail or when painting in a large area where the paint is still wet to avoid touching the surface accidentally. The ball-end of the mahl stick is rested on the edge of the canvas, on the easel, or even on a spot of the painting that's dry. The other end is held up with the artist's non-painting hand and the arm holding the brush is placed on the stick while painting.

The artist paint box or the pochade box forces the artist to handle wet canvases as they are placed in the box for transport, thus allowing the wet painting to accidentally be touched when being moved. Further the pochade box or a paint box does not provide a region for steadying a mahl stick.

SUMMARY

An object of this disclosure is to provide a support for artist canvases and panels on which an artist may work.

Another object of this disclosure is to provide a support for artist canvases and panels that may be secured to an easel or other support structure and allowing transport of the panels without touching wet paints or other drawing media.

Another object of this disclosure is to provide a support for artist canvases and panels that includes a mahl stick secured to the support to provide infinite adjustment of the mahl stick.

Another object of this disclosure is to provide a grid structure on the support for furnishing a reference for the artist in drawing horizontal and vertical lines.

In order to accomplish at least one of these objects, a painting support board is formed of a rectangular panel. The painting support board has any desired dimensions that can accommodate artist's panels having differing dimensions. In some embodiments, the panel is approximately 15"×18"×0.5". The panel is formed of a material such as cellulose based fiber wallboard, plywood, an engineered wood product constructed of wood fibers assembled with adhesives, fiberglass panels, high density plastic laminated panels (i.e. high density polyethylene), or any other suitable rigid panel material. In various embodiments, the panel is coated with a colored material such as a paint having a color such that the panel will mimic the structure of a frame in which the painting may be mounted. The color may be shiny gold or silver. Equally spaced lines are scribed on the colored panel to form a grid to allow the artist to more accurately paint straight lines.

The panel has multiple holes placed at various locations on the surface of the panel to accommodate artist's panel securing clip fasteners to the painting support board. One receiving fastener of a group of receiving fasteners is placed in each hole to accept a panel securing clip fastener to secure an artist's panel to the painting support board. In various embodiments the receiving fastener is internally threaded to accept a threaded fastener for securing the panel securing clip fastener to the painting support board. In some embodiments, the receiving fastener is externally threaded for securing the threaded receiving fastener to the painting support board. In other embodiments the threaded receiving fastener is press fit into the painting support board for securing the threaded receiving fastener using friction of the interface between the threaded receiving fastener and the painting support board.

In various embodiments, the panel securing clip has a Z-shaped holding element, formed with a first leg, a second leg, and a connecting member joining the first and second legs. The first leg of the Z-shaped holding element has a hole placed for retaining an attaching fastener that is inserted in the receiving fastener in the fastener holes. The second leg of the Z-shaped holding element of the panel securing clip has small extended member perpendicular to the second leg to apply a minimal surface are to the painting canvas or panel while securing the painting canvas or panel to the painting support board.

The attaching fastener that is secured to the panel securing clip is, in various embodiments, a threaded fastener such as a screw or bolt. In other embodiments, the attaching fastener is a cam lock fastener mating with a locking structure in the receiving fastener in the holes. Any type of locking or securing fastener suitable providing sufficient pressure to the panel securing clip to hold the artist's panel are in keeping with the intent of this disclosure. The length of the connecting member is sufficiently long for securing an artist's panel such as a stretched canvas panel or sufficiently short to secure wooden or other thin artist's panels. In various implementations of the current disclosure, the painting support board may be supplied with the multiple types of the panel securing clips, with various lengths of the connecting member for use with various thicknesses of the artist's panels.

In various embodiments of the painting support board, a loop strip of a hook and loop fastener system is placed near the periphery of the painting support board for temporarily attaching a mahl stick to the painting support board for aiding in detail or painting in a large area of the artist's panel when the paint is still wet for avoiding touching the surface accidentally. An associated mahl stick is provided with a hook pad of the hook and loop fastener system placed at one end of the mahl stick. This permits, the mahl stick to be temporarily secured to the painting support board at any position with the loop strip of the hook and loop fastener system so that the artist may support his hand during painting.

DETAILED DESCRIPTION

Figure 1:
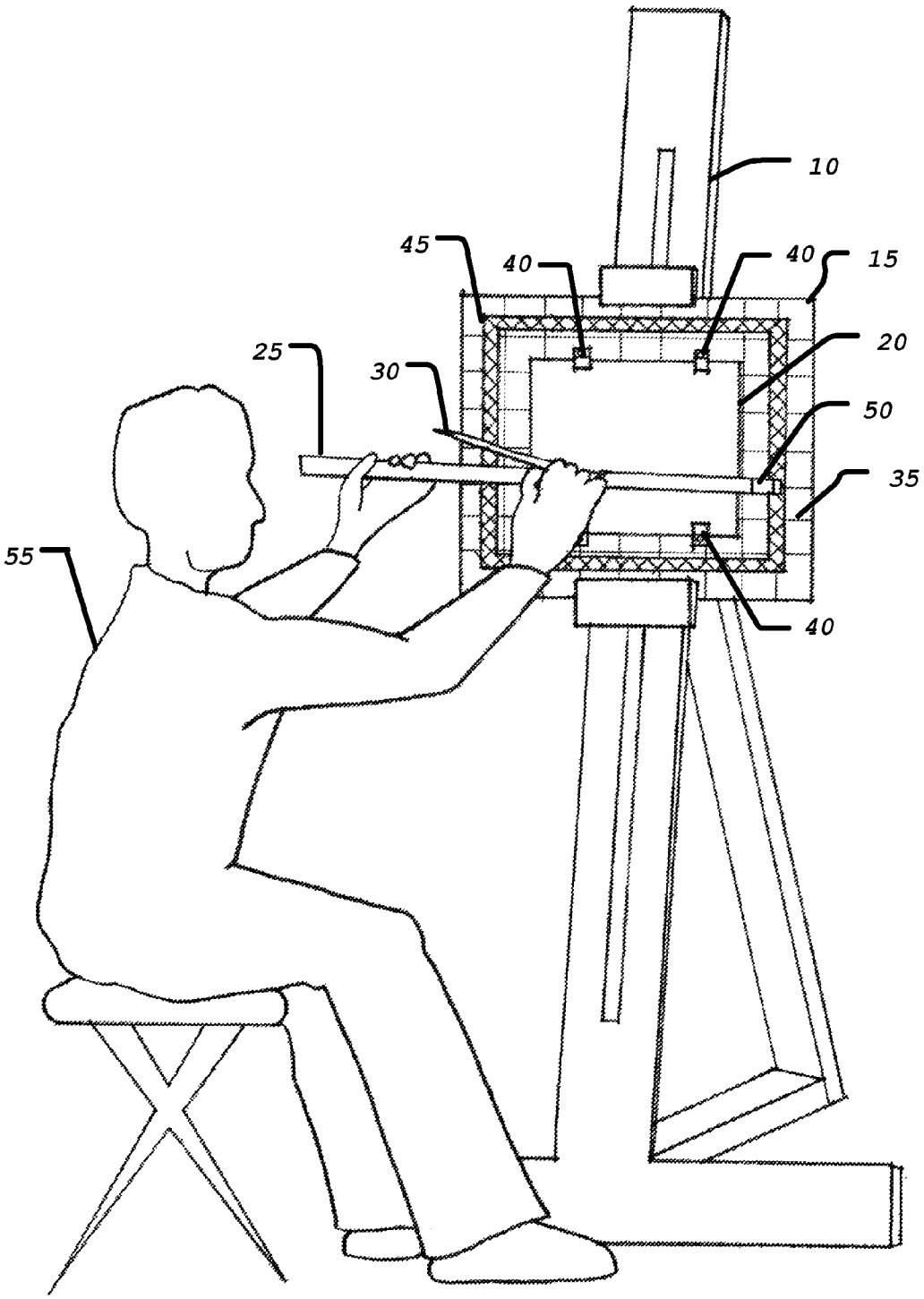
FIG. 1 is an illustration of the painting support board of this disclosure as secured to an easel.
Figure 2:
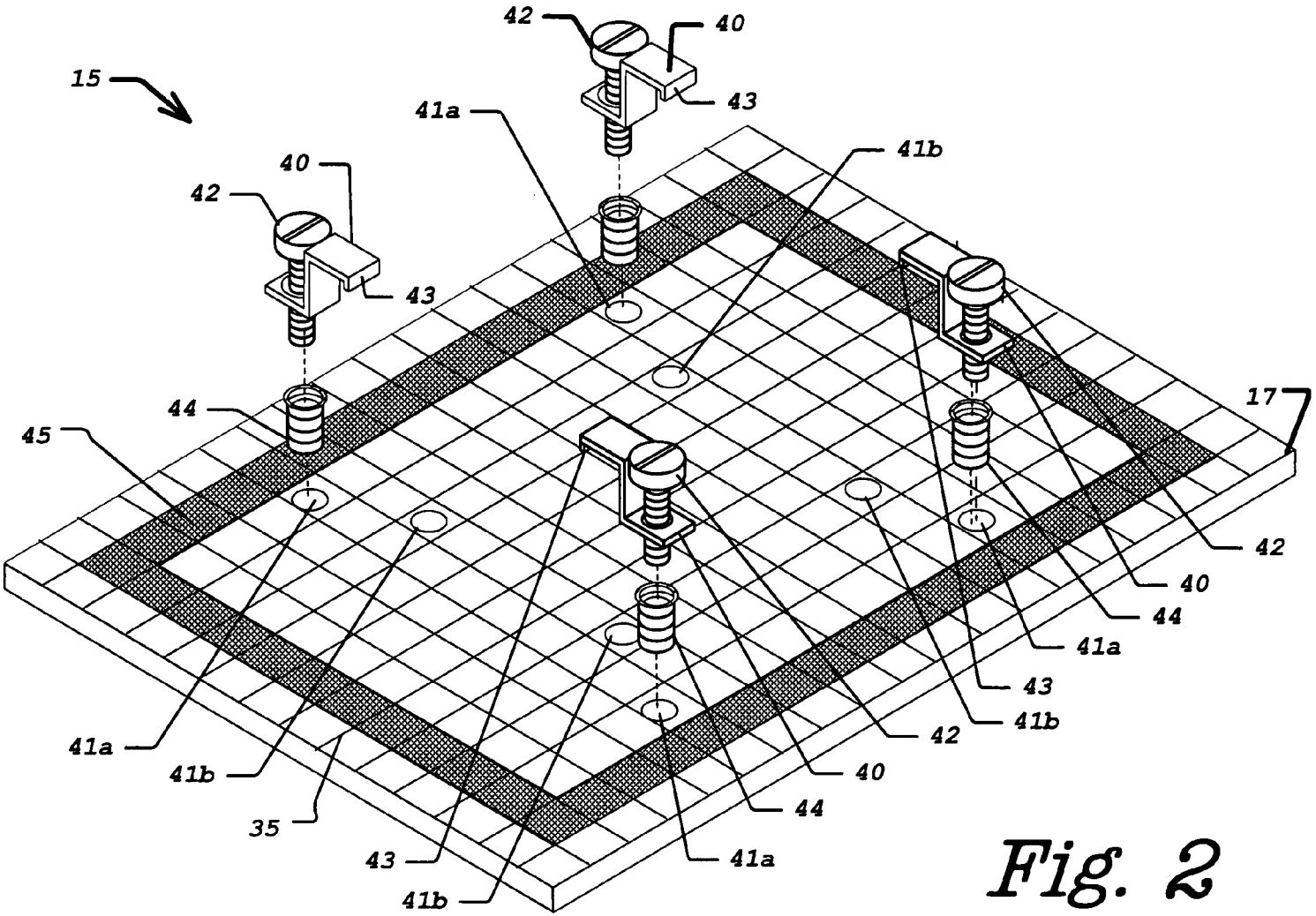
FIG. 2*a* is an illustration of the painting support board of this disclosure illustrating the panel securing clips embodying the principals of the present disclosure.
FIG. 2*b* is an illustration of the painting support board of this disclosure illustrating an attached fastener placed in an externally threaded receiving fastener placed in the fastener holes embodying the principals of the present disclosure.
FIG. 2*c* is an illustration of the painting support board of this disclosure illustrating an attached fastener placed in a press-fit receiving fastener placed in the fastener holes embodying the principals of the present disclosure.
Figures 2A, 2B, 2C:
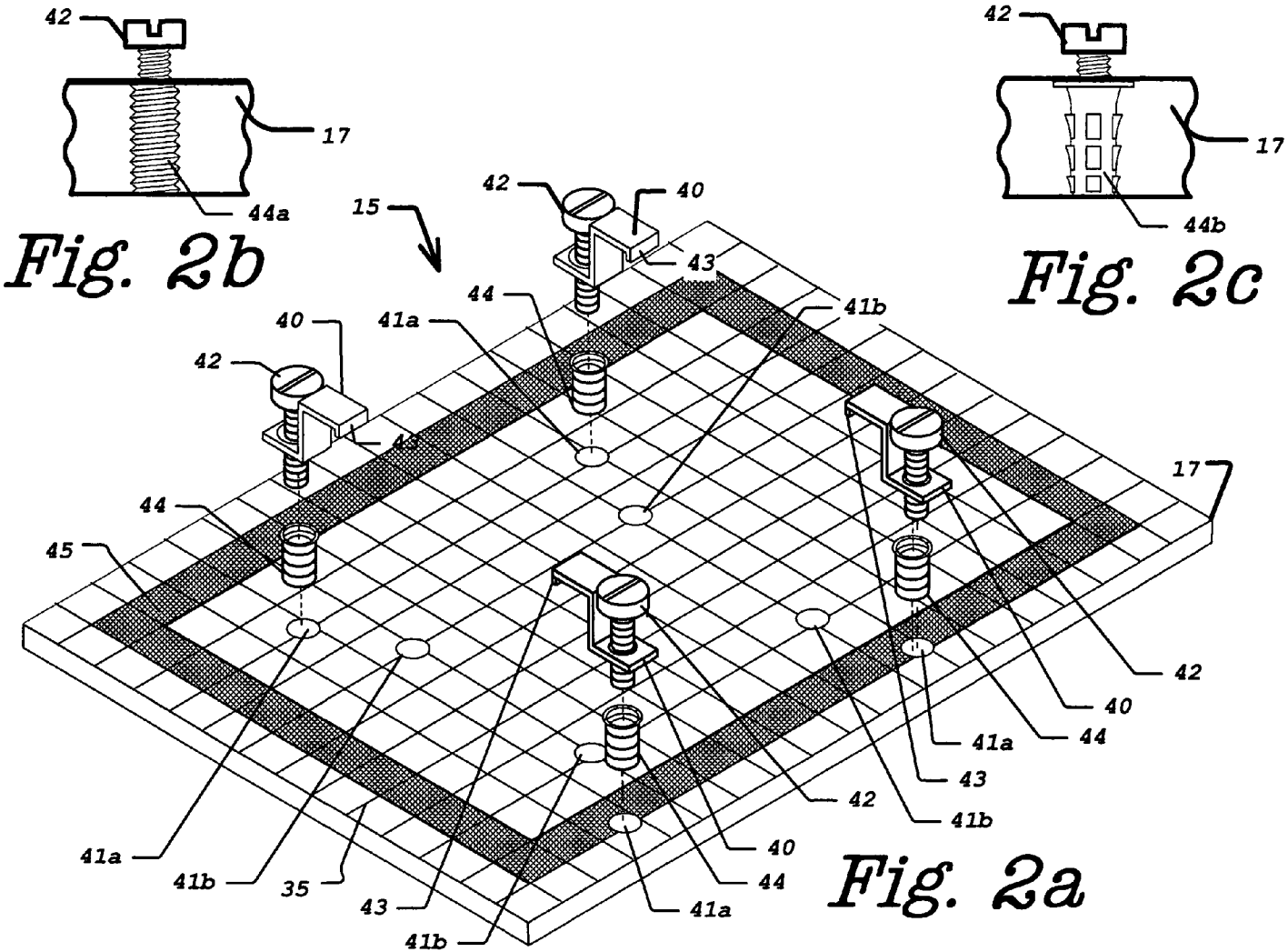
Figure 3:
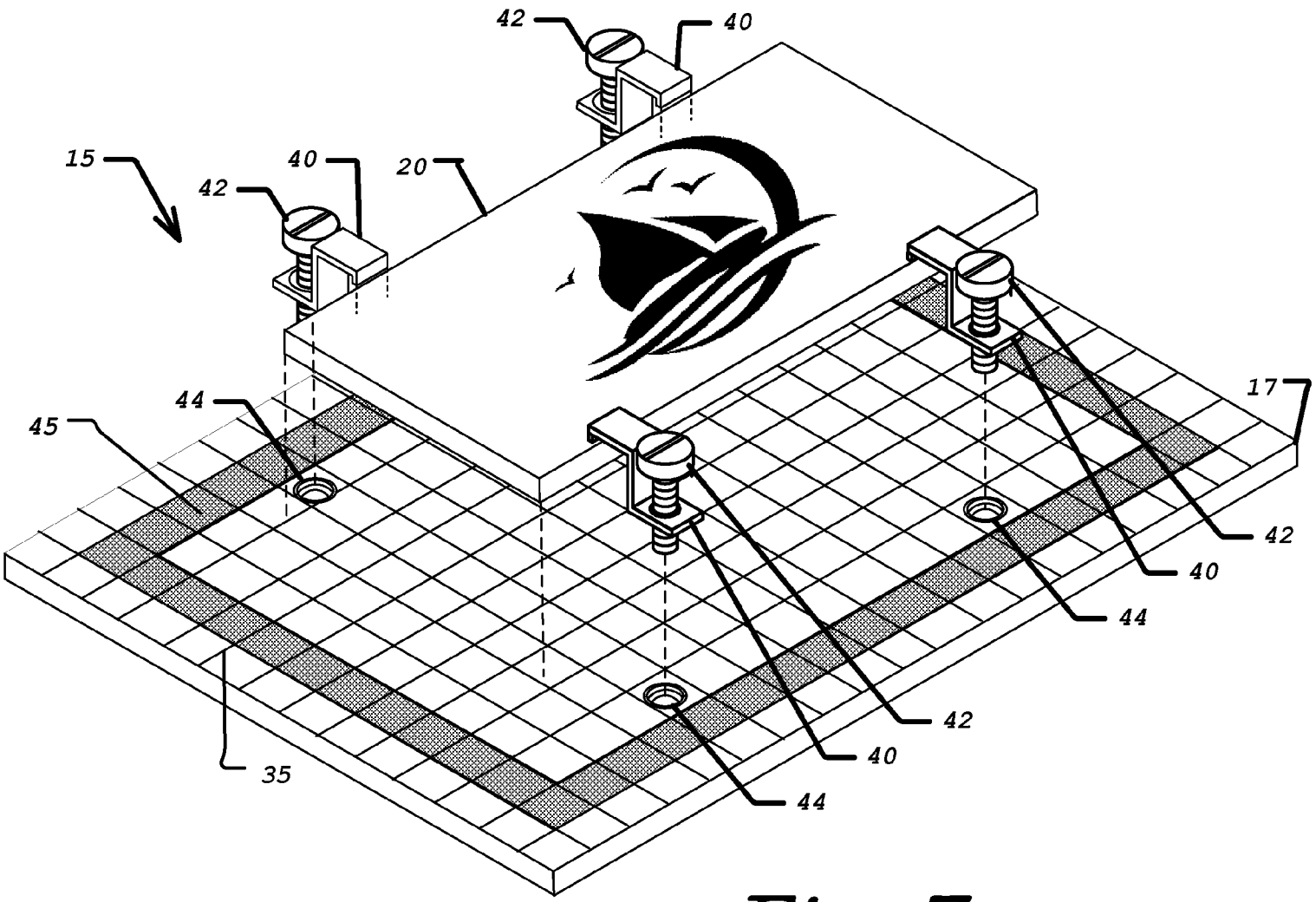
FIG. 3 is an illustration of an exploded view of the painting support board illustrating the mounting of an artist's panel of this disclosure.
Figure 4:
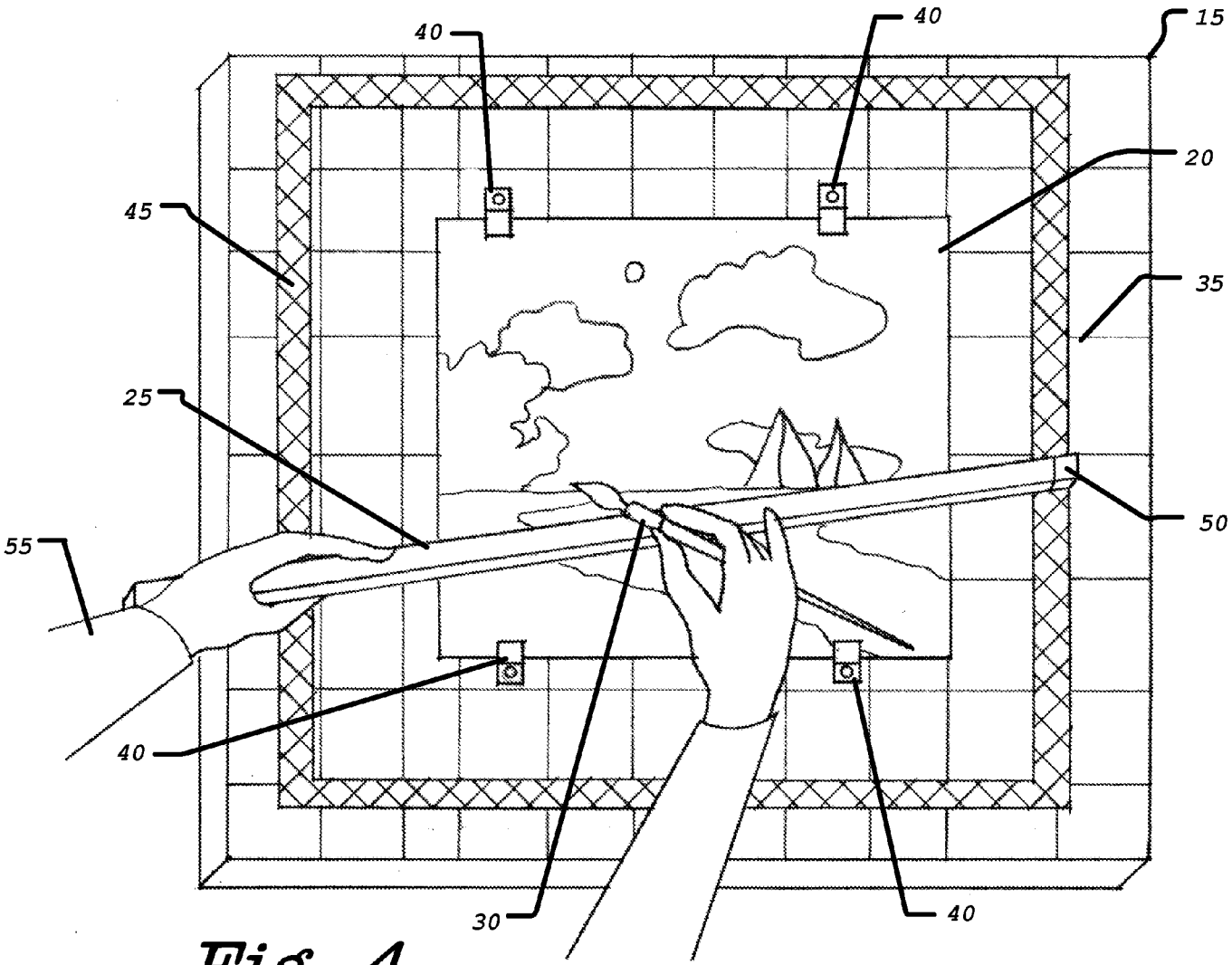
FIG. 4 is a drawing of the painting support board of this disclosure illustrating the use of a mahl stick secured to the painting support board.

FIG. 1 is an illustration of the painting support board 15 of this disclosure as secured to an easel 10. FIG. 2*a* is an illustration of the painting support board 15 of this disclosure illustrating the panel securing clips 40 embodying the principals of the present disclosure. FIG. 3 is an illustration of an exploded view of the painting support board 15 illustrating the mounting of an artist's panel or canvas 20 of this disclosure. FIG. 4 is a drawing of the painting support board 15 of this disclosure illustrating the use of a mahl stick 25 secured to the painting support board 15. Referring to FIGS. 1-4, the painting support board 15 is a board 17 for holding artist's panels or canvases 20 that are smaller than the painting support board 15. The painting support board 15 then easily sits on the easel 10 or any other platform or simply on the artist's 55 lap. The painting support board 15 isolates the painting canvas or panel 20 from its potentially distracting surroundings. The support board 15 is colored such that the area of the painting support board 15 surrounding the artist's panel or canvas 20 mimics the frame in which the finished painting will sit. There is a reference line grid 35 scribed onto the painting support board 15 used to more accurately draw and observe straight lines. There is a continuous loop strip 45 of a hook and loop system on all four sides of the painting support board 15.

A hand held mahl stick 25 with hook patch 50 of the hook and loop system placed on a tip of the mahl stick 25 that allows the artist 55 to attach the mahl stick 25 anywhere on the support board 15 to the continuous loop strip 45 to steady and support the hand while painting. The hook and loop system for the mahl stick 25 allows infinite adjustment of the mahl stick 25 relative to the canvas or panel 20 while painting. The mahl stick 25 and the support board's grid 35 also assists in painting straight lines and the edges of perpendicular and other straight edged objects within the canvas or panel 20 while painting.

Fastener holes 41*a* and 41*b* are placed at fixed locations on the support board 15 such that the locations of the fastener holes allow attaching several different sizes of the paint canvases and panels 20. The painting support board 15 also serves as a convenient and tidy way to transport the paint canvases and panels 15 if used outside or within the studio. The wet paint edges of the canvas or panel 20 will not touch the hands or the area in which it is placed while still attached to the painting support board 15.

The painting support board 15 is a panel or board 17 constructed of cellulose based fiber wallboard, plywood, an engineered wood product constructed of wood fibers assembled with adhesives, fiberglass panels, high density plastic laminated panels (i.e. high density polyethylene), or any other suitable rigid panel material. The board 17 is cut to any convenient size but in various embodiments, the board 17 is approximately ½ inch thick by 15 inches high by 18 inches long. The cellulose based fiber wallboard is a material such as the product manufactured by Homasote Company of West Trenton, N.J. 08628. The painting support board 15 may be any color but preferably shiny gold or silver to mimic the color of a potential frame for a painting or other artistic work placed on the canvas or panel 20. There are reference grid lines 35 of any spacing increment scribed on the painting support board 15. In various embodiments, the reference grid lines 35 have a spacing of one inch increments forming a square line grid over the whole surface of the painting support board 15.

Drilled fastener holes 41*a* and 41*b* for accepting receiving fasteners 44 are place in specified fixed locations in the surface of the painting support board 15 such that two panel securing clips 40 are placed at a first side (i.e. top) and two panel securing clips 40 are placed at a second side (i.e. bottom) of the painting support board 15. In various embodiments, one hole 41*a* and 41*b* is 1¾ inches from the bottom and 4 inches from the left side of the board 17. A second hole 41*a* and 41*b* is 3½ inches from the bottom and 5 inches from the left side of the board 17. A third hole is 1½ inch from the top and 4 inches from the left side of the board 17. A fourth hole is 2½ inches from the top and 5 inches from the left side of the board 17. A fifth hole is 1½ inches from the top and 4½ inches from the right. A sixth hole is 2½ inches from the top and 5½ inches from the right side of the board 17. A seventh hole is 3½ inches from the bottom and 4½ inches from the right side of the board 17. An eighth hole is 1½ inches from the bottom and 4½ inches from the right side of the board 17. The locations of the fastener holes 41*a* and 41*b* are placed in the painting support board 15 to ensure that a minimum amount of the painting canvas or panel 20 is contacted to secure the painting canvas or panel 20 to the painting support board 15.

FIG. 2*b* is an illustration of the painting support board 15 illustrating an attached fastener 42 placed in an externally threaded receiving fastener 44*a* placed in the fastener holes 41*a* and 41*b* embodying the principals of the present disclosure. FIG. 2*c* is an illustration of the painting support board 15 illustrating an attached fastener 42 placed in a press-fit receiving fastener 44*c* placed in the fastener holes 41*a* and 41*b* embodying the principals of the present disclosure. Referring to FIG. 2*a*, once the fastener holes 41*a* and 41*b* are placed in the painting support board 15, one receiving fastener 44 is placed in each of the fastener holes 41*a* and 41*b* and secured to retain the painting canvas or panel to the support board 15. The receiving fastener 44 of FIG. 2*a* may be an externally threaded receiving fastener 44*a* as shown in FIG. 2*b*. The externally threaded receiving fastener 44*a* is threaded into the fastener holes 41*a* and 41*b* and the attached fastener 42 is place in the opening of the externally threaded receiving fastener 44*a* to mate with the internal threads. Alternately, the receiving fastener 44 of FIG. 2*a* may be a press-fit receiving fastener 44*b* as shown in FIG. 2*c*. The press-fit receiving fastener 44*b* is forcefully placed into the fastener holes 41*a* and 41*b* such that the curved hooks 46 lock firmly into the sidewalls of the fastener holes 41*a* and 41*b* to secure the receiving press-fit receiving fastener 44*b*. A panel securing clip 40 with an attached fastener 42 is placed in each of the receiving fasteners 44 placed in the fastener holes 41*a* and 41*b* and secured to retain the painting canvas or panel to the support board. The fastener holes 41*a* are arranged for securing a canvas or panel 20 of a first set of dimensions and the fastener holes 41*b* are arranged for securing a canvas or panel 20 of a second set of dimensions.

The receiving fastener 44 is internally threaded to accept a threaded fastener 42 attached to the panel securing clip 40 for securing the panel securing clip 40 to the painting support board 15. The receiving fastener 44 is externally threaded for securing the threaded receiving fastener 44 to the painting support board 15. Alternatively, the threaded receiving fastener 44 is press fit into the painting support board 15 for securing the receiving fastener 44 using friction of the interface between the threaded receiving fastener and the painting support board. As is known in the art, numerous companies such as Thor International Pte Ltd., Singapore 408564 provide various fasteners having internal and external threads and press fit fasteners having internal threading. Similarly, Specialty Fasteners & Components LTD, Devon, TQ9 5AL, England provides various cam lock fasteners mating with a locking structure suitable for being the attached fastener 43 mating to the receiving fastener 44 in one the holes 41*a* and 41*b*.

The panel securing clip 40 has a Z-shaped holding element, with one leg of the Z-shaped holding element having a hole placed for retaining the attached fastener 42 that is inserted in the receiving fastener 44. The securing leg of the Z-shaped holding element of the panel securing clip 40 has a small extended member 43 perpendicular to the securing leg to apply a minimal surface area to the painting canvas or panel 15.

The attached fastener 42 attached to the panel securing clip 40 is, in various embodiments, a threaded fastener such as a screws or bolt. In other embodiments, the fastener is a cam lock fastener mating with a locking structure in the receiving fastener 44 in one the holes 41*a* and 41*b*. Any type of locking or securing fastener suitable providing sufficient pressure to the panel securing clip 40 to hold the painting canvas or panel 15 are in keeping with the intent of this disclosure.

The length of the attached fasteners 42 connected to the panel securing clips 40 are such that they allow the painting canvas or panel 20 to be mounted to the painting support board 15 and mate with the receiving fasteners 44 to secure the painting canvas or panel 20. In various embodiments, the attached fasteners connected to the panel securing clips 40 are approximately 1 inch long and approximately ½ inch in diameter. The receiving fasteners 44 in the fastener holes have a length sufficient for securing to the support board 17.

The securing leg of the Z-shaped holding element of the panel securing clip 40 are of various lengths, for example 1/16", ⅛", ¼", ⅜", ½", ¾" and 1 inch increments for securing the painting canvas or panel 20 to the support board 15. The painting canvas or panel 20 may be of any dimension, however the locations of the fastener holes 41*a* and 41*b* are placed such that standard dimensions of canvas panels 20 are used with one of the panel securing clips 40 with an appropriate length of the securing leg of the panel securing clip 40.

Loop strips 45 of the hook and loop system are attached to the board 17 preferably as a continuous ½ inch strip indented ½ inch from the edge along all four sides of the support board 15. The loop strips 45 provide an attachment area to hold the mahl stick 25 during painting. The loop strips 45 are adhered to the support board 17 such that they are replaceable when the loop strips 45 have lost their adhesion properties during use.

The accompanying mahl stick 25 has a hook patches 50 adhered to the mahl stick 25. The mahl stick 25 may be of any suitable dimension or material (wood being preferable). The preferable dimensions are approximately 1 inch square and 18 inches long with a 1 inch by 1 inch hook strip 50 on all four sides of one end and covering the end tip of the mahl stick 25.

Figure 5:
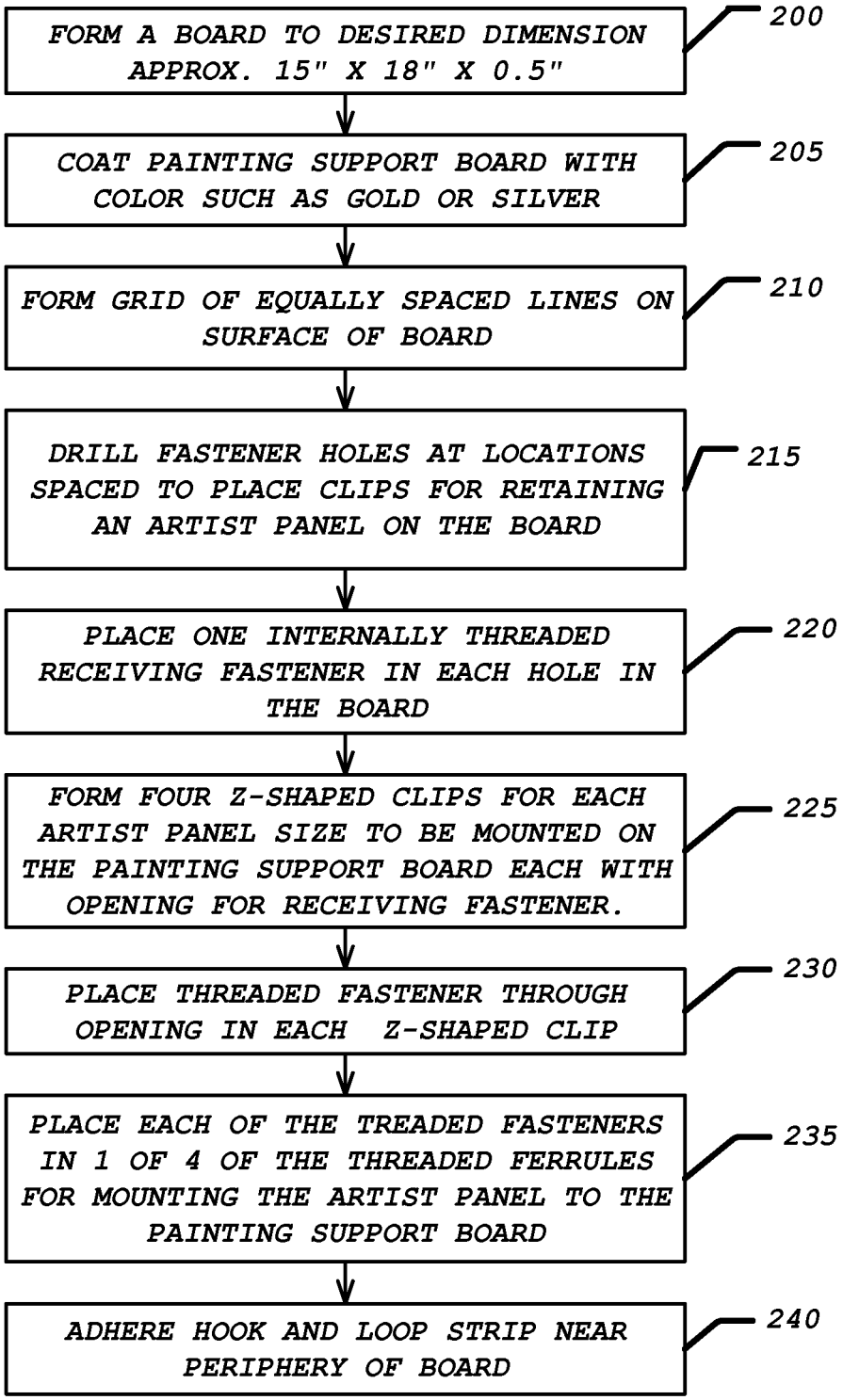
FIG. 5 is a flowchart illustrating a method for forming a painting support board.
Figure 6:
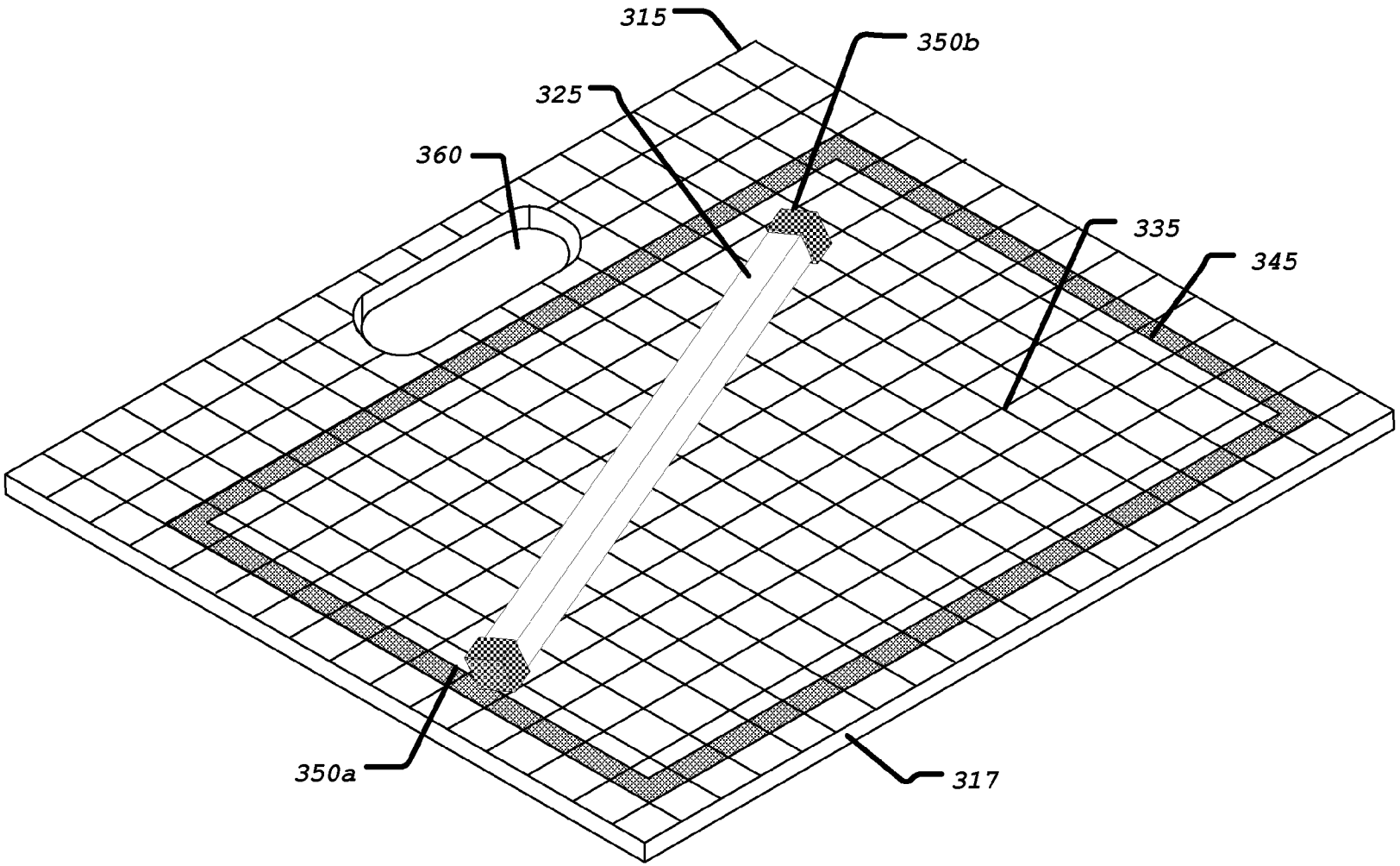

FIG. 5 is a flowchart illustrating a method for forming a painting support board 15. Referring to FIGS. 2, 3, and 5, a rigid board 17 is formed (Box 200) to any desired dimensions. In various embodiments, the board 17 is formed (Box 200) to approximately 15"×18"×0.5". The board 17 is coated (Box 205) with a colored material such as a paint having a color such that the board 17 will mimic the structure of a frame in which the painting may be mounted. The colored material is commonly a shiny gold or silver material.

Reference grid lines 35 of any equal spacing increment are formed (Box 210) on the board 17. In various embodiments, the reference grid lines 35 have a spacing of one inch increments forming a square line grid over the whole surface of the board 17.

Fastener holes 41*a* and 41*b* are drilled (Box 215) in the surface of the board 17 at locations to place panel securing clips 40 at a first side (i.e. top) and two at a second side (i.e. bottom) of the board 17. In various embodiments, one hole 41*a* and 41*b* is 1¾ inches from the bottom and 4 inches from the left side of the board 17. A second hole 41*a* and 41*b* is 3½ inches from the bottom and 5 inches from the left side of the board 17. A third hole is 1½ inch from the top and 4 inches from the left side of the board 17. A fourth hole is 2½ inches from the top and 5 inches from the left side for locating a first artist's canvas or panel 20. A fifth hole is 1½ inches from the top and 4½ inches from the right. A sixth hole is 2½ inches from the top and 5½ inches from the right side of the board 17. A seventh hole is 3½ inches from the bottom and 4½ inches from the right side of the board 17. An eighth hole is 1½ inches from the bottom and 4½ inches from the right side for locating a second sized artist's canvas or panel 20. The locations of the fastener holes 41*a* and 41*b* are placed in the painting support board 15 to ensure that a minimum amount of the painting canvas or panel 20 is contacted to secure the painting canvas or panel 20 to the painting support board 15.

Once the fastener holes 41*a* and 41*b* are placed in the painting support board 15, one threaded receiving fastener 44 is placed (Box 220) in each of the fastener holes 41*a* and 41*b*.

The panel securing clip 40 is formed (Box 225) with a Z-shaped holding element. One leg of the Z-shaped holding element is drilled to have a hole placed for accepting and retaining (Box 230) the attached fastener 42. The attached fastener 42 is inserted (Box 235) in the receiving fastener 44 in one of the fastener holes 41*a* and 41*b*. The securing leg of the Z-shaped holding element of the panel securing clip 40 has small extended member 43 perpendicular to the securing leg to apply a minimal surface area to the painting canvas or panel 15.

Loop strips 45 of a hook and loop system are attached (Box 240) to the board 17 preferably as a continuous ½ inch strip indented ½ inch from the edge along all four sides of the support board 15. The loop strips 45 provide an attachment area to hold a mahl stick 25 during painting. The loop strips 45 are adhered to the support board 17 such that they are replaceable when the loop strips 45 have lost their adhesion properties during use.

An accompanying mahl stick 25 is provided with a hook patches 50 adhered to the mahl stick 25. The mahl stick 25 formed to any suitable dimension or material (wood being preferable). The preferable dimensions are approximately 1 inch square and 18 inches long with a 1 inch by 1 inch hook strip 50 on all four sides of one end and covering the end tip of the mahl stick 25.

While this disclosure has been particularly shown and described with reference to the preferred embodiments thereof, it will be understood by those skilled in the art that various changes in form and details may be made without departing from the spirit and scope of the disclosure.

What is claimed is:

1. An artist's medium support system configured for supporting one of a plurality of the artist's mediums to allow ease of work and transportation of the artist's medium, the support system comprising:

a rectangular painting support board formed of a rigid material having a length and a width for accommodating a largest of the artist's mediums wherein each of the artist's mediums has a length, a width, and a thickness that differs from the other artist's mediums;

a coating applied to the painting support board of a color such that the painting support board mimics the color of a frame into which the artist's medium may be mounted;

a plurality of equally spaced lines placed on the surface of the painting support board to form a grid such that the artist is able to use the grid for approximating straight lines during painting, sketching or drawing and to gauge distance within a scene being painted, sketched or drawn during the painting, sketching, or drawing;

a mahl stick comprising:

an elongated stick of a length and thickness and of a substance for providing support for an artist's arm and brush while painting, sketching or drawing;

a hook strip of a hook and loop system attached at one end of the mahl stick and covering an end tip of the mahl stick and a loop strip of the hook and loop fastener system adhered near the periphery of the painting support board for temporarily attaching the hook strip mounted to the mahl stick to the painting support board for aiding in supporting the artist's arm and brush while painting, sketching or drawing to avoid touching the surface of the artist's medium accidentally.

2. The artist's medium support system of claim 1 wherein the loop strip of the hook and loop system is attached to the painting support board as a continuous ½ inch strip indented ½ inch from the edge along all four sides of the painting support board.

3. The artist's medium support system of claim 2 wherein the loop strip is adhered to the painting support board such that the loop strip is replaceable when the loop strip has lost its adhesion properties during use.

4. The artist's medium support system of claim 1 wherein the mahl stick has dimensions that are approximately 1 inch square and 18 inches long and the hook strip has dimensions of approximately 1 inch by 1 inch.

5. The artist's medium support system of claim 1 wherein the mahl stick is wood.

6. The artist's medium support system of claim 1 wherein the painting support board has dimensions of approximately 15"×18"×0.5".

7. The artist's medium support system of claim 1 wherein the rigid material forming the painting support board is cellulose based fiber wallboard, plywood, an engineered wood product constructed of wood fibers assembled with adhesives, fiberglass panels, high density plastic laminated panels (i.e. high density polyethylene), or any rigid panel material.

8. The artist's medium support system of claim 1 further comprising a plurality of fastener holes placed in the painting support board at fixed locations on the painting support board, such that the fixed locations of the fastener holes are for attaching a plurality differently sized artist's mediums:

a plurality of receiving fasteners wherein one receiving fastener is placed in each of the fastener holes; and a plurality of panel securing clips, wherein one panel securing clip of the plurality of panel securing clips is affixed within each receiving fastener for securing the artist's medium to the painting support board, the panel securing clip comprising:

a Z-shaped holding element having a first leg with a hole, a securing second leg having an extended member perpendicular to the securing second leg for securing the artist's medium to the rectangular panel, and a connecting member joining the first leg with the hole and the securing second leg, and an attaching fastener placed through the hole within the first leg of the Z-shaped holding element.

9. The artist's medium support system of claim 8 wherein the receiving fastener is internally threaded to accept a threaded fastener for securing one retaining clip to the painting support board.

10. The artist's medium support system of claim 8 wherein the receiving fastener is externally threaded for securing the receiving fastener to the painting support board.

11. The artist's medium support system of claim 8 wherein the receiving fastener is press fit into the painting support board for securing the receiving fastener using friction of the interface between the receiving fastener and the painting support board.

12. The artist's medium support system of claim 8 wherein the attaching fasteners are screws or bolts.

13. The artist's medium support system of claim 8 wherein the plurality of panel securing clips includes a plurality of sets of four panel securing clips wherein one set of panel securing clips is associated with each artist's medium to be supported by the artist's medium support system wherein the connecting members and the extended member from the securing second leg of the one set of panel securing clips associated with one artist's medium have a length for accommodating the thickness of the associated artist's medium.

14. A method for forming an artist's medium support system configured for supporting one of a plurality of the artist's mediums to allow ease of work and transportation of the artist's medium, the method for forming the support system comprising the steps of:

forming a rectangular painting support board of a rigid material having a length and a width for accommodating a largest of the artist's mediums wherein each of the artist's medium has a length, a width, and a thickness that is differs from the other artist's mediums;

applying a coating to the painting support board of a color such that the painting support board mimics the color of a frame into which the artist's medium may be mounted;

placing a plurality of equally spaced lines on the surface of the painting support board to form a grid such that the artist is able use the grid for approximating straight lines during painting, sketching or drawing and gauge distance within a scene being painted, sketched or drawn during the painting, sketching, or drawing forming the mahl stick comprising the steps of:

forming an elongated stick of a length and thickness and of a substance to provide support for an artists arm and brush while painting, sketching or drawing;

adhering a hook strip of a hook and loop system at one end of the mahl stick; and covering an end tip of the mahl stick with the hook strip; and adhering a loop strip of the hook and loop fastener system near the periphery of the painting support board for temporarily attaching the hook strip mounted to the mahl stick to the painting support board for aiding in supporting the artists arm and brush while painting, sketching or drawing to avoid touching the surface of the artist's medium accidentally.

15. The method for forming the artist's medium support system of claim 14 wherein adhering the loop strip of the hook and loop system to the painting support board comprises placing a continuous ½ inch strip of the loop strip indented ½ inch from the edge along all four sides of the painting support board.

16. The method for forming the artist's medium support system of claim 15 wherein the loop strip is adhered to the painting support board such that the loop strip is replaceable when the loop strip has lost its adhesion properties during use.

17. The method for forming the artist's medium system of claim 14 wherein the mahl stick has dimensions that are approximately 1 inch square and 18 inches long and the hook strip has dimensions of approximately 1 inch by 1 inch.

18. The method for forming the artist's medium support system of claim 14 wherein the mahl stick is wood.

19. The method for forming the artist's medium support system of claim 14 wherein the painting support board has dimensions of approximately 15"×18"×0.5".

20. The method for forming the artist's medium support system of claim 14 wherein the rigid material forming the painting support board is cellulose based fiber wallboard, plywood, an engineered wood product constructed of wood fibers assembled with adhesives, fiberglass panels, high density plastic laminated panels (i.e. high density polyethylene), or any rigid panel material.

21. The method for forming the artist's medium support system of claim 14 further comprising the steps of:

making a plurality of fastener holes placed in the painting support board at fixed locations on the painting support board, such that the fixed locations of the fastener holes for attaching a plurality differently sized artist's mediums:

placing a plurality of receiving fasteners in each of the fastener holes; and forming a plurality of panel securing clips, each panel securing clip formed by the steps of:

forming a Z-shaped holding element by the steps of:

forming a first leg, a second leg, and a connecting member joining the first leg and the second leg, forming a hole within a first leg of the Z-shaped holding element, forming an extended member perpendicular to the second leg for securing the artist's medium to the rectangular panel, and forming a connecting member joining the first leg with the hole and the securing second leg; and providing an attaching fastener; and placing the attaching fastener through the hole within the first leg of the Z-shaped holding element.

22. The method for forming the artist's medium of claim 21 further comprises forming the receiving fastener by the step of internally threading the receiving fastener to accept a threaded attaching fastener for securing retaining clip to the painting support board.

23. The method for forming the artist's medium support system of claim 21 wherein forming the receiving fastener further comprises the step of externally threading the receiving fastener for securing the receiving fastener to the painting support board.

24. The method for forming the artist's medium support system of claim 21 wherein forming the receiving fastener further comprises the step of forming the receiving fastener to be press fit into the painting support board for securing the receiving fastener using friction of the interface between the receiving fastener and the painting support board.

25. The method for forming the artist's medium support system of claim 21 wherein the attaching fasteners are screws or bolts.

26. The method for forming the artist's medium support system of claim 21 wherein the plurality of panel securing clips includes four panel securing clips for each artist's medium to be supported by the artist's medium support system and the step of forming the plurality of panel securing clips further comprises the step of:

forming the connecting members and the extended member from the securing leg having a length for accommodating a thickness of each of the artist's mediums.

* * * * *